US005683642A

United States Patent [19]

Muguruma et al.

[11] Patent Number: 5,683,642

[45] Date of Patent: Nov. 4, 1997

[54] PC STRAND COATED WITH RUST INHIBITOR AND METHOD FOR PRODUCING THE SAME

[75] Inventors: Hiroshi Muguruma, Kyoto; Kazuyoshi Chikiri, Fukuchiyama; Yukihiro Higashi, Sakai, all of Japan

[73] Assignees: Hien Electric Industries, Ltd, Osaka; Times Engineering, Ltd., Tokyo, both of Japan

[21] Appl. No.: 551,449

[22] Filed: Nov. 1, 1995

Related U.S. Application Data

[63] Continuation of Ser. No. 289,227, Aug. 12, 1994, abandoned.

[30] Foreign Application Priority Data

Dec. 2, 1993 [JP] Japan ..... 5-338887
May 27, 1994 [JP] Japan ..... 6-138000

[51] Int. Cl.[6] ..... B29B 13/00

[52] U.S. Cl. ..... 264/271.1; 264/45.9; 264/176.1; 264/209.3; 264/259; 57/221; 57/223; 57/295; 57/314; 57/313; 57/296; 57/297; 57/232; 29/460; 29/461; 52/736

[58] Field of Search ..... 264/45.9, 176.1, 264/177.17, 209.3, 228, 259, 271.1, 273; 428/357, 68.1, 377, 379, 383, 597, 375, 380, 592, 605, 467; 57/221, 223, 295, 314, 313, 296, 297, 232, 219; 29/460, 461; 52/736

[56] References Cited

U.S. PATENT DOCUMENTS 3,922,437 11/1975 Kitta et al. .
4,469,756 9/1984 Jungwirth et al. .
4,612,680 9/1986 Daiguji .
4,776,161 10/1988 Sato et al. .
5,263,307 11/1993 Hasui .

*Primary Examiner*—Merrick Dixon
*Attorney, Agent, or Firm*—Armstrong, Westerman, Hattori, McLeland & Naughton

[57] ABSTRACT

A PC strand is formed by twisting peripheral wires made of deformed PC steel wires around a core, and allowing rust inhibitive material of thermoplastic resin to permeate into voids defined among the core and peripheral wires by use of an extruder. Since at least one of the core and peripheral wires is made of a deformed PC steel wire having an uneven outer surface, the thermoplastic resin can smoothly permeate deep into the inside of the PC strand.

8 Claims, 10 Drawing Sheets

PC STRAND COATED WITH RUST INHIBITOR AND METHOD FOR PRODUCING THE SAME

This application is a Continuation of application Ser. No. 08/289,227 filed Aug. 12, 1994, now abandoned.

BACKGROUND OF THE INVENTION

1. Field of the Invention

This invention relates to a PC strand coated with rust inhibitive material, which is used for stressing prestressed concrete or as a suspender cable for a suspension bridge, and a method for producing the coated PC strand.

2. Description of the Prior Art

In recent years, there have been developed a PC strand applied for a posttension unbond method, which is coated with sticky synthetic resin and inserted into a synthetic resin sheath, and another PC strand applied for a pretension bond method, which is placed within concrete in use after being coated with synthetic resin and strained. (Japanese Patent Application Public Disclosure No. HEI 1-215528(A))

Such conventional PC strands inevitably embrace small spaces or voids around a core and peripheral wires in spite of coating of the synthetic resin. The small spaces or voids disadvantageously permit water and air to sink from the end of the stand into the inside of the strand through the voids, thus to possibly corrode the core and peripheral wires of the strand.

There has been so far proposed a method for solving such a problem, which comprises previously coating string wires one by one with synthetic resin, twisting the string wires to form a strand body, and further coating the strand body with synthetic resin. (Japanese Patent Application Public Disclosure No. SHO 61-144121(A))

The PC strand produced by the proposed method however suffers a disadvantage such that residual stress caused by twisting the string wires remains in the strand because the PC strand is not subjected to bluing treatment. Consequently, the conventional PC strand is apt to untwist and destabilize its strength. Besides, since the core and peripheral wires are individually coated with synthetic resin so as to interpose synthetic resin among the core and wires, the PC strand resultantly produced is elastically lengthened particularly when it is forcibly stretched.

There has been enveloped a method for permitting the PC strand to be free from these disadvantages, in which the PC strand is coated with rust inhibitive material while being passed through a pressure head in a synthetic resin extruder under a high pressure (about 100 kgf/cm$^2$ or more) so as to press the synthetic resin into the voids among the core and wires of the strand under pressure. (Japanese Pat. Appln. Public Disclosures Nos. HEI 5-98742(A) and HEI 5-37331 (A))

However, this prior art method calls for heavy pressure to press the molten synthetic resin into the voids within the PC strand through narrow openings between the peripheral wires in order to effect rust prevention. This disadvantage becomes conspicuous with increasing viscosity of the molten synthetic resin. Thus, there is a limit in ability of preventing the core and peripheral wires from rusting.

Although the aforementioned prior art method is applicable to a PC strand having the peripheral wires twisted around the core, it cannot be applied to a PC strand of multilayer structure comprising a core, an intermediate layer of twisted wires, and an outer layer of twisted wires.

OBJECT AND SUMMARY OF THE INVENTION

In the light of the foregoing actual state of affairs, the present invention was made to provide a PC strand coated with synthetic resin, in which internal voids defined among a core and twisted peripheral wires are completely filled with rust inhibitive material, and in particular, a method for coating a PC strand of multilayer structure with the synthetic resin serving as a rust inhibitor, by which the synthetic resin can be effectively pressed deep into the inside of the PC strand by use of a synthetic resin extruder.

To attain the object described above according to this invention, there is provided a PC strand coated with rust inhibitive material, which comprises a core coated with a rust inhibitor of thermoplastic resin and twisted peripheral wires coated with a rust inhibitor of thermoplastic resin. The peripheral wires twisted around the core are made of deformed PC steel wires having entirely or partly uneven outer surfaces.

A method for coating the PC strand with rust inhibitive material according to this invention comprises twisting, around a core, peripheral wires including at least one deformed PC steel wire with an uneven outer surface so as to form a strand body having one or more layers of peripheral wires around the core, passing the strand body through a synthetic resin extruder while pressing molten thermoplastic resin into the inside of the strand body by a pressure head of the extruder while being heated, and passing the strand body applied with the molten thermoplastic resin through a molding die located at the front end of the pressure head so as to bring the molten thermoplastic resin into intimate contact with the entire peripheries of the core and peripheral wires.

The deformed PC steel wires may be applied to the core, all the peripheral wires or every other peripheral wire.

Since the PC strand according to this invention is formed by twisting the core and peripheral wires including the deformed PC steel wires having uneven outer surfaces by a strong uniting force, voids are positively formed among the core and peripheral wires and completely filled with molten thermoplastic resin with the pressure produced by the pressure head. Since the molten thermoplastic resin is heated by the extruder, it can permeate deep into the inside of the PC strand without decreasing viscosity. After the thermoplastic resin is hardened by cooling, the PC strand becomes stiff and remarkably strengthened.

Other and further objects of this invention will become obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

Other objects and features of the present invention will be hereinafter explained in detail with reference to the accompanying drawings, wherein.

DESCRIPTION OF THE PREFERRED EMBODIMENTS

This invention will become more fully understood from the detailed description given hereinbelow and the accompanying drawings which are given by way of illustration only, and thus are not limitative of the present invention.

Figure 1:
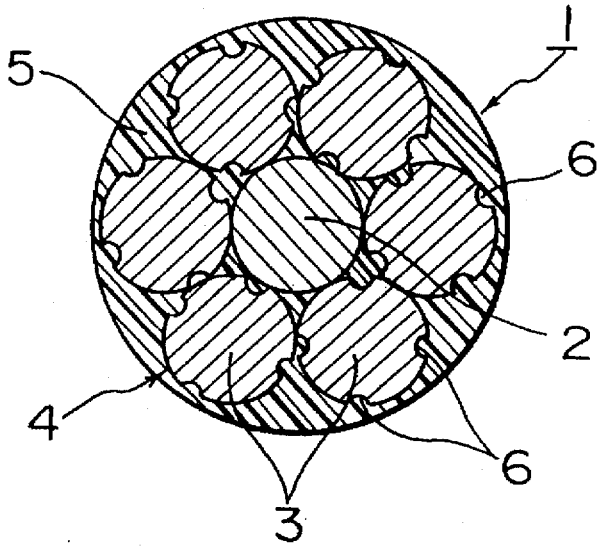
FIG. 1 is a sectional view showing a first embodiment of the PC strand coated with rust inhibitive material according to this invention.
Figure 5A:
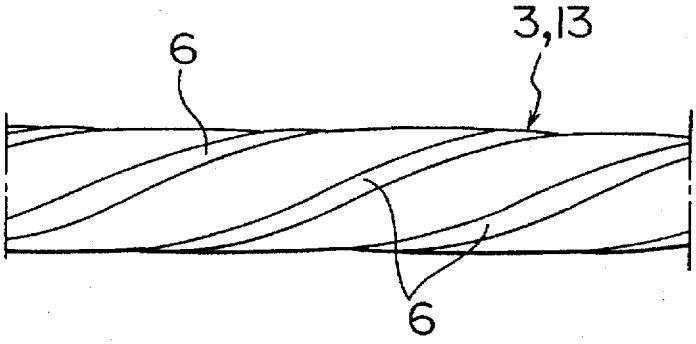
FIGS. 5(A) and 5(B) are a side view and a sectional view showing one peripheral wire used in the PC strand of the first or second embodiment.
Figure 5B:
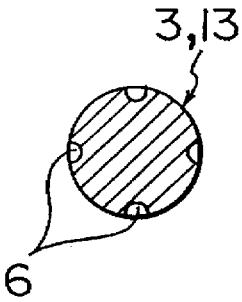

In FIG. 1 showing one embodiment of this invention, a PC strand 1 coated with rust inhibitive material comprises one core 2 and six peripheral wires 3 which constitute a strand body 4, and rust inhibitive material 5. That is, the strand body 4 is formed by spirally winding the peripheral wires 3 of PC steel around the core 2 of PC steel. The peripheral wire 3 is made of a deformed PC wire having grooves 6 in its peripheral surface as illustrated in FIG. 5.

The core 2 and peripheral wires 3 each are covered with the rust inhibitive material 5. The rust inhibitive material 5 is generally made of polyethylene resin, but should not be understood as limitative. That is to say, the rust inhibitive material may be of thermoplastic resin such as polypropylene, copolymer of polyethylene and polypropylene, its denatured composition, and nylon resin.

Figure 2:
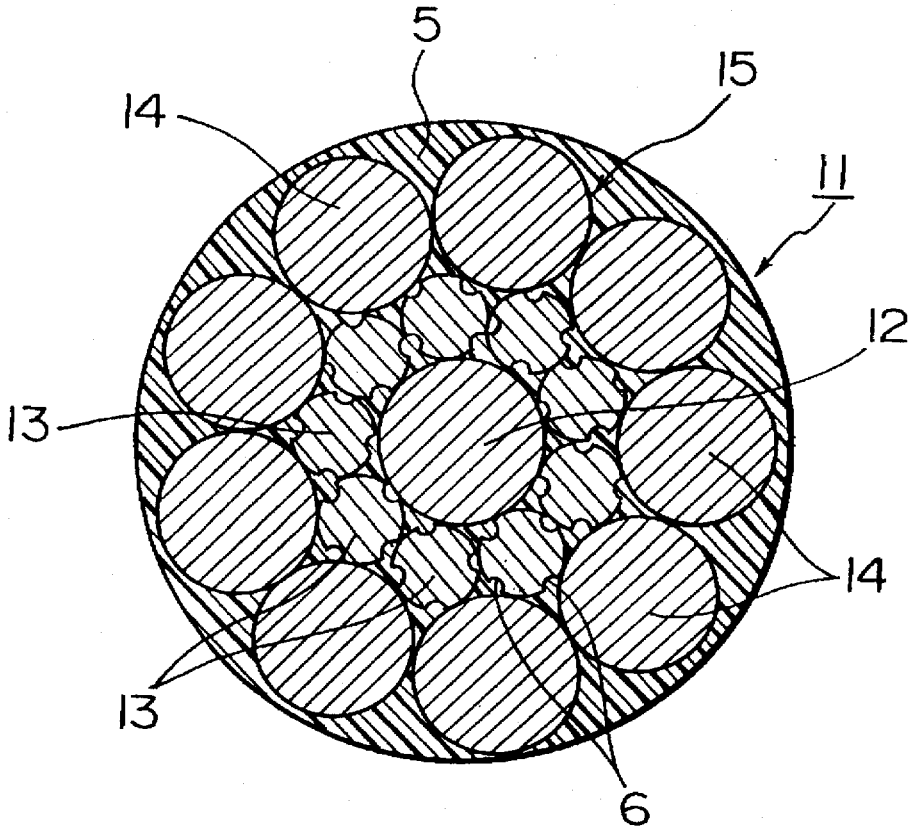
FIG. 2 is a sectional view of a second embodiment of the same.

FIG. 2 shows the second embodiment of the PC strand coated with rust inhibitive material according to this invention. This PC strand 11 has a multilayered strand body 15 comprising one core 12, an intermediate layer of nine peripheral wires 13 spirally wound around the core 12, and an outer layer of nine peripheral wires 14 spirally wound around the intermediate layer. The strand body 15 is coated with rust inhibitive material 5. The peripheral wire 13 of the intermediate layer is made of a deformed PC steel wire having spiral grooves 6 as shown in FIG. 5. The core 12 and the peripheral wire 14 are made of an ordinary PC steel wire having a flat outer periphery.

Figure 3:
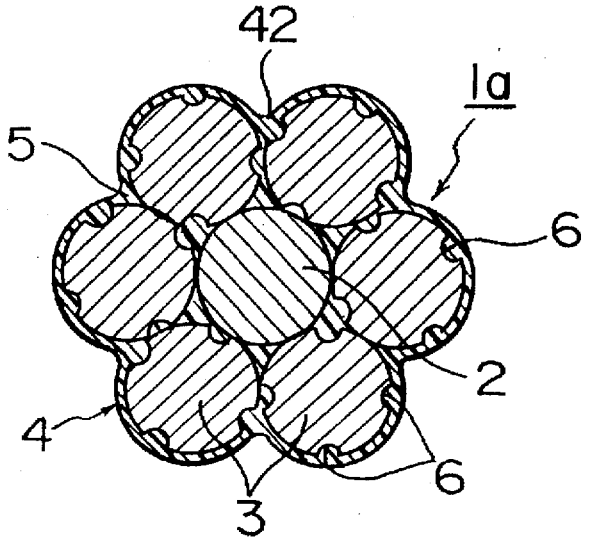
FIG. 3 is a sectional view of a third embodiment of the same.
Figure 4:
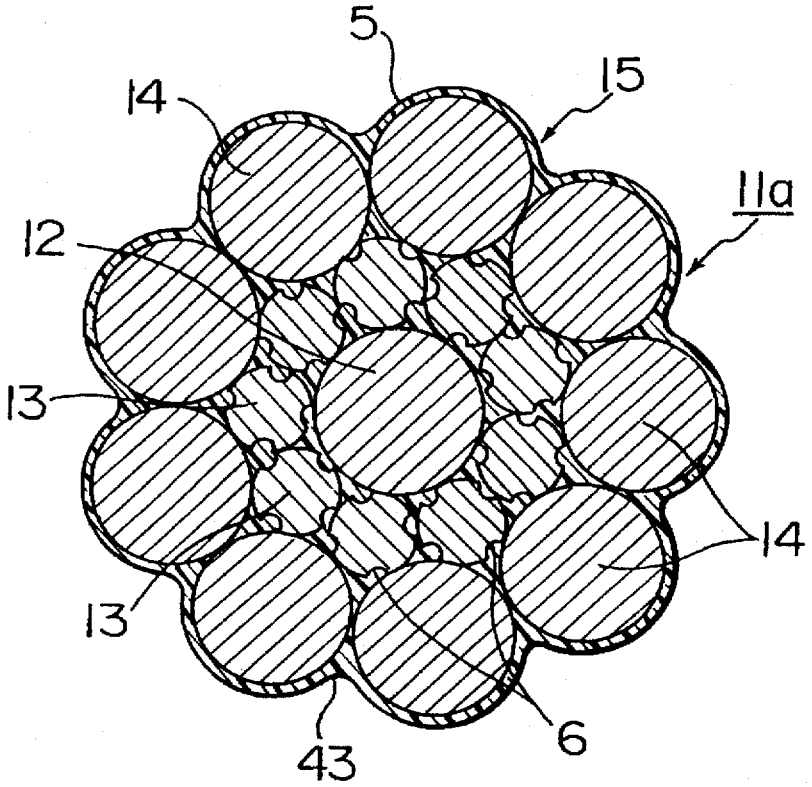
FIG. 4 is a sectional view of a fourth embodiment of the same.

FIGS. 3 and 4 show the third and fourth embodiments of the PC strand coated with rust inhibitive material. The PC strands 1*a* and 11*a* of these embodiments are made by forming spiral depressions 42 and 43 parallel to the peripheral wires 3 and 14 of the PC strands 1 and 11 of the first and second embodiments described above.

Also, the outer peripheral wire 14 may of course be made of the deformed PC steel wire as shown in FIG. 5.

Figure 6A:
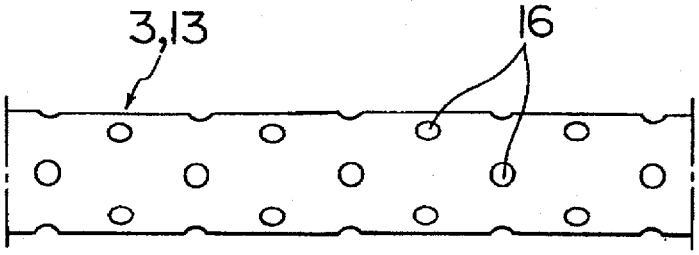
FIGS. 6(A) and 6(B) are a side view and a sectional view showing one peripheral wire used in another embodiment.
Figure 6B:
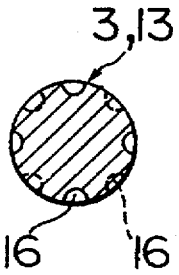
Figure 7A:
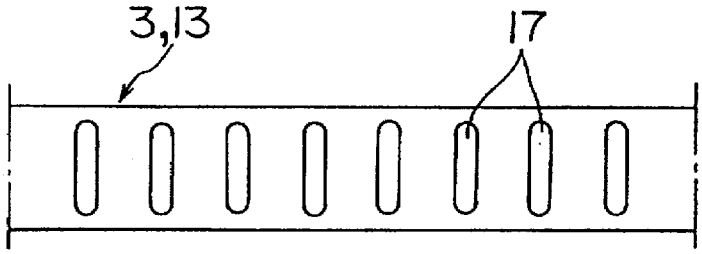
FIGS. 7(A) and 7(B) are a side view and a sectional view showing one peripheral wire used in still another embodiment.
Figure 7B:
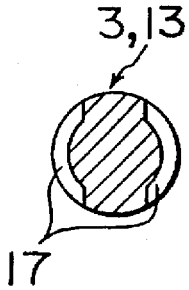
Figure 8A:
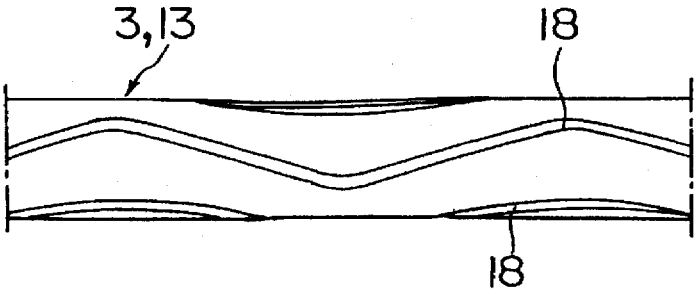
FIGS. 8(A) and 8(B) are a side view and a sectional view showing one peripheral wire used in yet another embodiment.
Figure 8B:
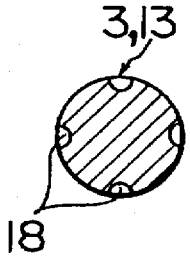

The deformed PC steel wire may be formed with slender grooves spirally extending longitudinally as shown in FIG. 5, dot-like grooves 16 as shown in FIG. 6, sideways short grooves 17 as shown in FIG. 7, or zigzag grooves 18 extending substantially in the longitudinal direction as shown in FIG. 8.

Figure 9:
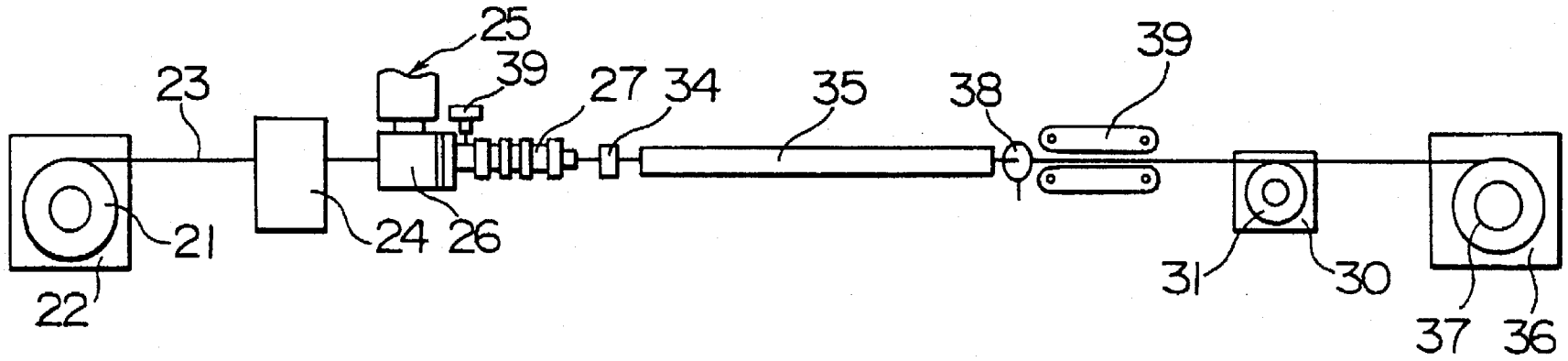
FIG. 9 is a schematic diagram showing one example of a processing system according to this invention.

The process of coating the PC strand with rust inhibitive material according to the present invention will be described hereinafter with reference to FIG. 9.

First, a PC strand supply 21 for supplying a strand body 23 (shown in FIG. 11 and FIG. 12) of the PC strand body 4 or 15 to be resultantly made into the aforesaid PC strand 1 or 11 is set in a strand delivery device 22 so as to continuously send out the strand body 23.

The strand body 23 successively sent out is passed through and heated by a heating device 24 and then introduced into a synthetic resin extruder 25. The heating temperature at which the strand body is heated by the heating device 24 is maintained at about 200° C.

Figure 10:
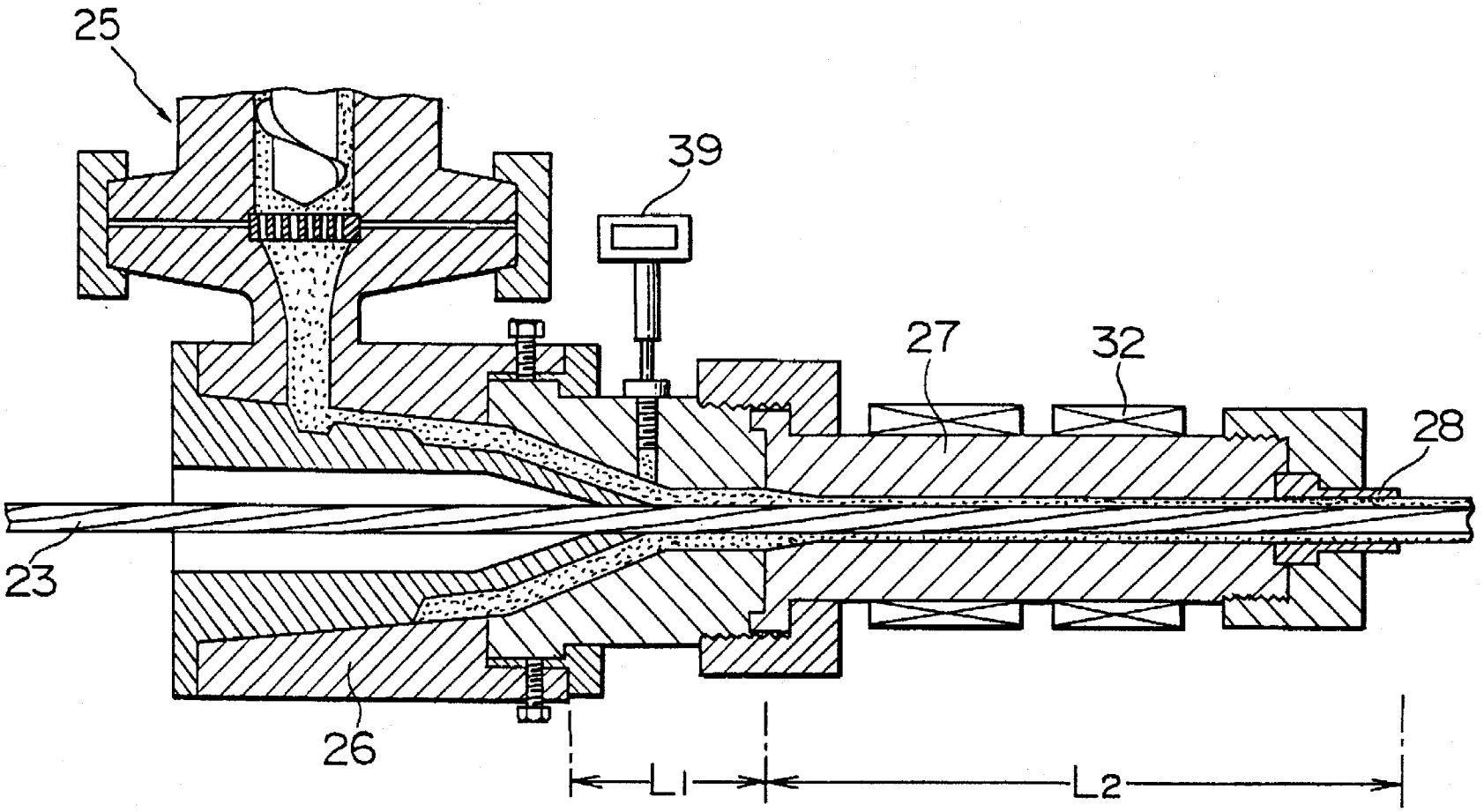
FIG. 10 is a sectional view showing, in part, an extruder used in the processing system of FIG. 9.

The extruder 25 comprises a cross head 26, an auxiliary pressure head 27 attached to the front end of the cross head 26, and a molding die 28 attached to the front end of the pressure head 27, as shown in FIG. 10.

The PC strand body 23 heated by the heating device 24 is passed through the cross head 26, auxiliary pressure head 27 and molding die 28, and connected to a lead wire (not shown). The lead wire is pulled by a drawing device 29 and wound up round a lead wire reel 31 by a lead wire winding device 30.

The rust inhibitive material 5 of thermoplastic resin in this embodiment is melted by being heated at about 200° C. in the extruder 25 and forcibly fed from the cross head 26 into the auxiliary pressure head 27. The rust inhibitive material may be of thermoplastic resin such as polypropylene, copolymer of polyethylene and polypropylene, its denatured composition, and nylon resin, as touched upon above.

The auxiliary pressure head 27 attached to the cross head 26 can be heated by a heater 32 so that the molten thermoplastic resin can effectively permeate into the PC strand body 23 without being cooled. When using thermoplastic resin of amorphous polymer having low molecular weight, it is not necessarily heated.

The rust inhibitive material 5 of thermoplastic resin to be forcibly fed into the cross head 26 is introduced into the auxiliary pressure head 27 and discharged together with the PC strand body 23 from the molding die 28 attached to the front end of the auxiliary pressure head. At the time that the PC strand body passes through the molding die, the resin pressure of the rust inhibitive material 5 is increased over a prescribed pressure so as to allow the rust inhibitive material to permeate deep into the inside of the PC strand body. In the case of the PC strand shown in FIG. 11, the rust inhibitive material 5 is forcibly pushed into voids "a" defined around the core 2 and peripheral wires 3 through openings between the outer peripheral wires 3.

The grooves formed in the peripheral wires 3 made of deformed steel wires allow the rust inhibitive material 5 to be easily spread throughout the voids around the core and peripheral wires, consequently to completely fill the voids in the PC strand and effectively coat the PC strand with rust inhibitive material.

Figure 12:
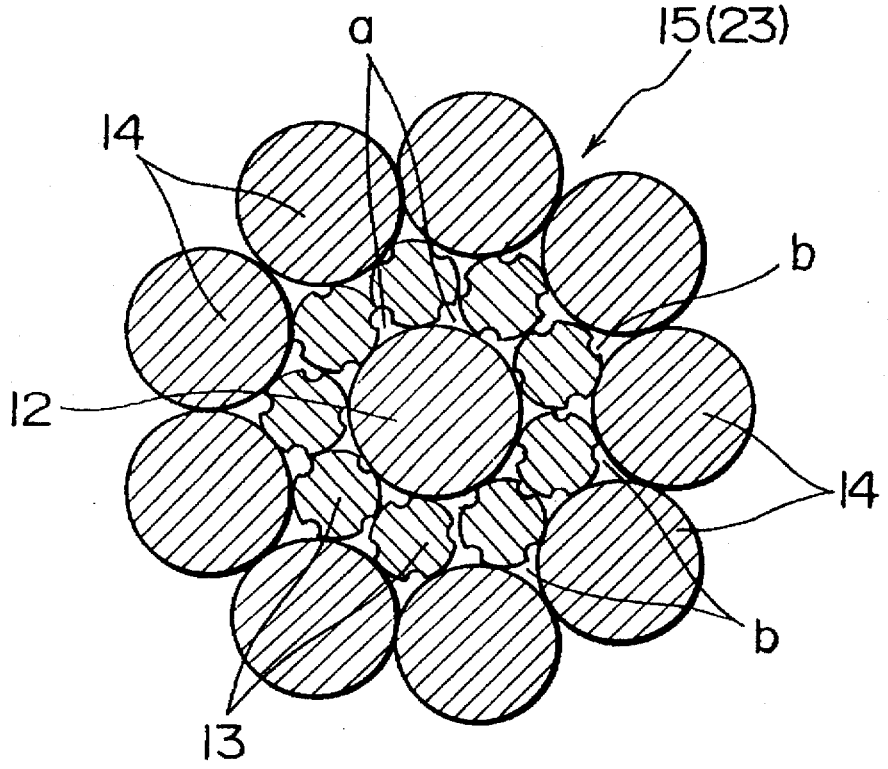
FIG. 12 is a cross section of another example of the PC strand used in this invention.

In the case of the PC strand body having a plurality of layers of twisted wires as shown in FIG. 12, the rust inhibitive material 5 passes into the voids among the outer peripheral wires 14 and intermediate peripheral wires 13 through openings between the outer peripheral wires 14, and further permeates deep into the voids around the core 12 through opening between the intermediate peripheral wires 13. As a result, the voids "a" within the PC strand body 23 are completely filled with the rust inhibitive material 5, and all the core 12 and wires 13 and 14 are entirely coated with the rust inhibitive material 5.

Figure 11:
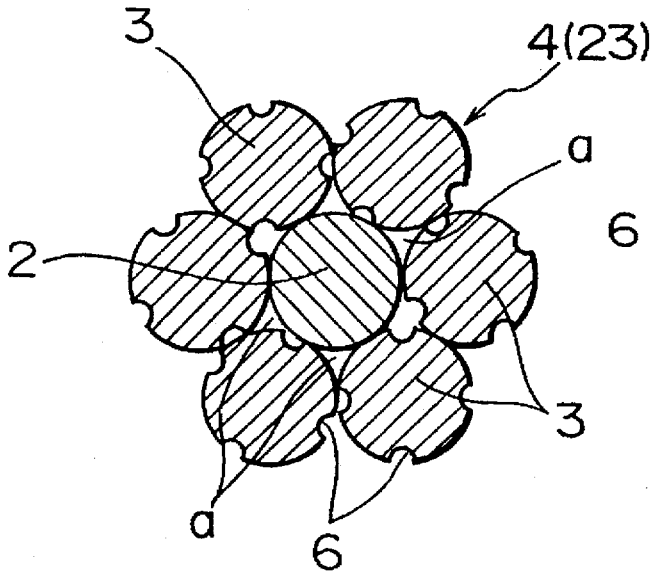
FIG. 11 is a cross section of one example of the PC strand used in this invention.

In the case that the PC strand body 23 of FIG. 11 is coated with the rust inhibitive material of polyethylene resin, the resin pressure in the auxiliary pressure head 27 is preferably 80 to 100 kgf/cm$^2$. In the case of the multilayered PC strand 23 shown in FIG. 12, the resin pressure more than 100 kgf/cm$^2$ is necessary.

The length $L_2$ of the auxiliary pressure head 27 in the present invention is longer than the length $L_1$ of the molding die in a cross head which is used commonly. It is preferable to determine the length $L_2$ when using amorphous polymer having low molecular weight to more than two times $L_1$, and that when using thermoplastic resin to more than three times $L_1$. When $L_2$ is more than five times $L_1$, it is desirable to provide an auxiliary molding die 34 for pressing the strand once again, because the coating of the rust inhibitive material on the strand swells during passage through the long path of $L_2$.

After the PC strand coated with the rust inhibitive material 5 of thermoplastic resin passes through the molding die 28 or auxiliary molding die 34, it is cooled by a cooling device 35 and wound up by a reel 37 of a winding device 36. In the drawing, reference numeral 39 denotes a pressure gauge.

The PC strand may possibly pass a corona discharge processing device 38 after passing through the cooling device 35 in order to make the outer surface of the PC strand rough for the purpose of increasing adhesion to concrete or other materials.

The PC strand thus produced is completely coated with the rust inhibitive material as shown in FIGS. 1 and 2.

Figure 18:
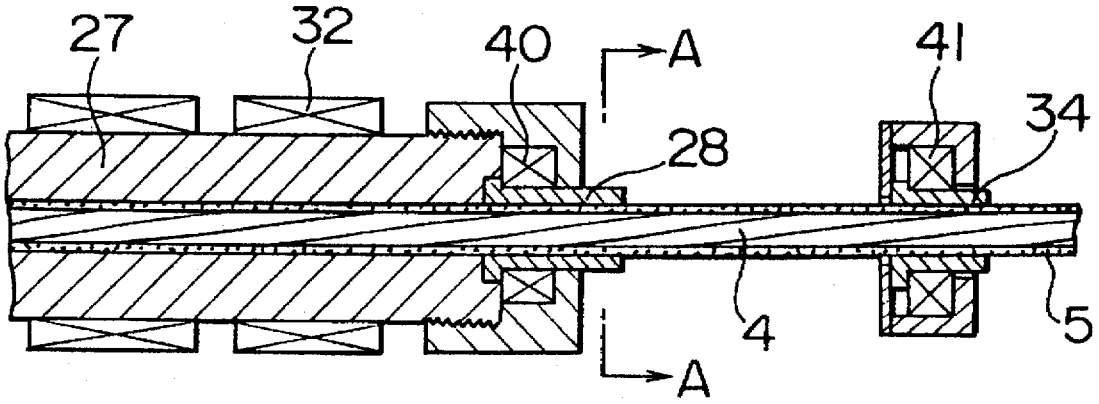
FIG. 18 is a sectional view showing a molding die used in the other embodiment of this invention.
Figure 19:
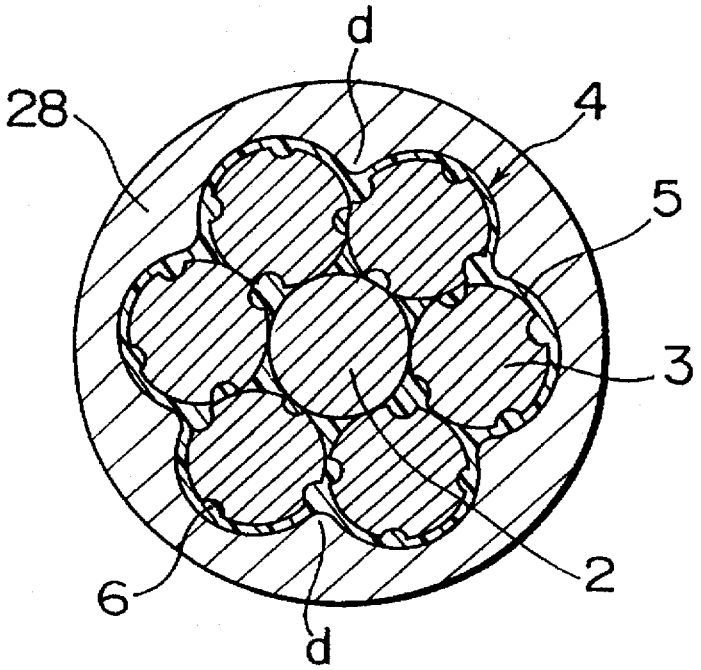
FIG. 19 is a section taken on line A—A in FIG. 18.

The molding die 28 and auxiliary molding die 34 each may have inner protrusions conforming with the spiral depressions formed in the outer surface of the PC strand 23 as shown in FIG. 19, so that they can be held rotatably by bearings 40 and 41 so as to rotate as the PC strand 23 is forwarded, as illustrated in FIG. 18. In this case, the PC strand resultantly produced has the depressions 42 or 43 in the outer surface of the rust inhibitive coating, which correspond to the concavities defined between the peripheral wires 3 or 14 of the strand 4 or 15, as shown in FIG. 3 or FIG. 4.

Figure 13:
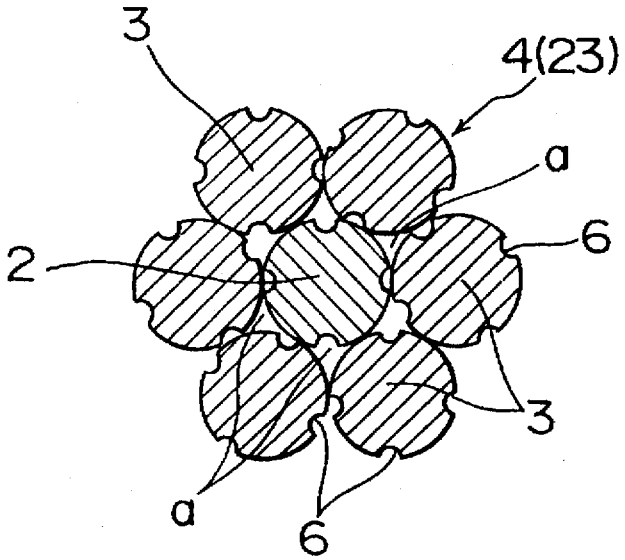
FIG. 13 is a cross section of still another example of the PC strand used in this invention.
Figure 14:
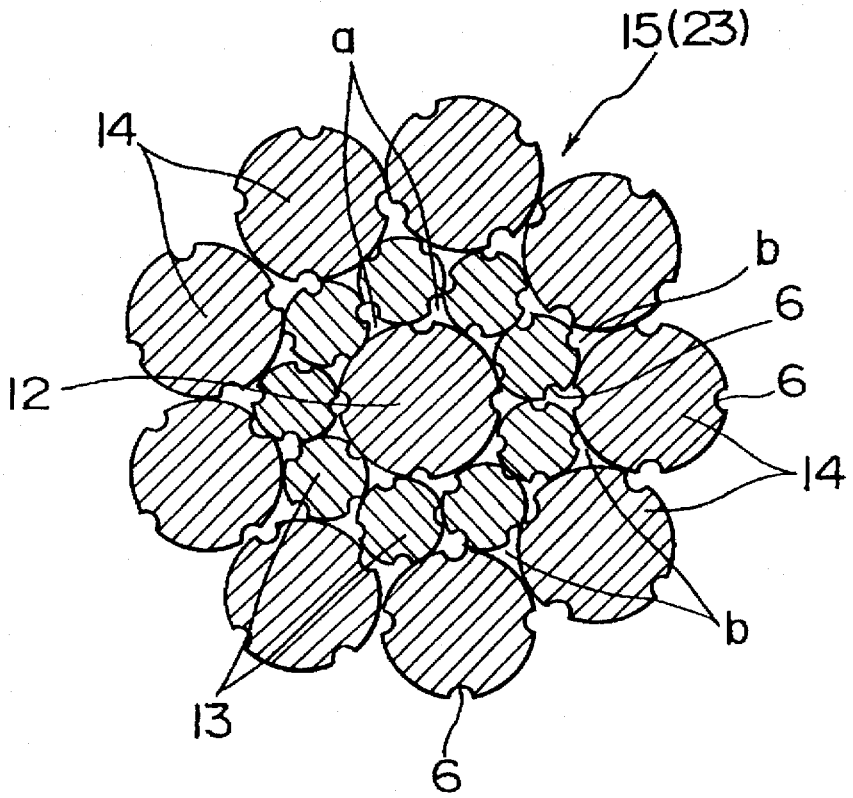
FIG. 14 is a cross section of yet another example of the PC strand used in this invention.
Figure 15:
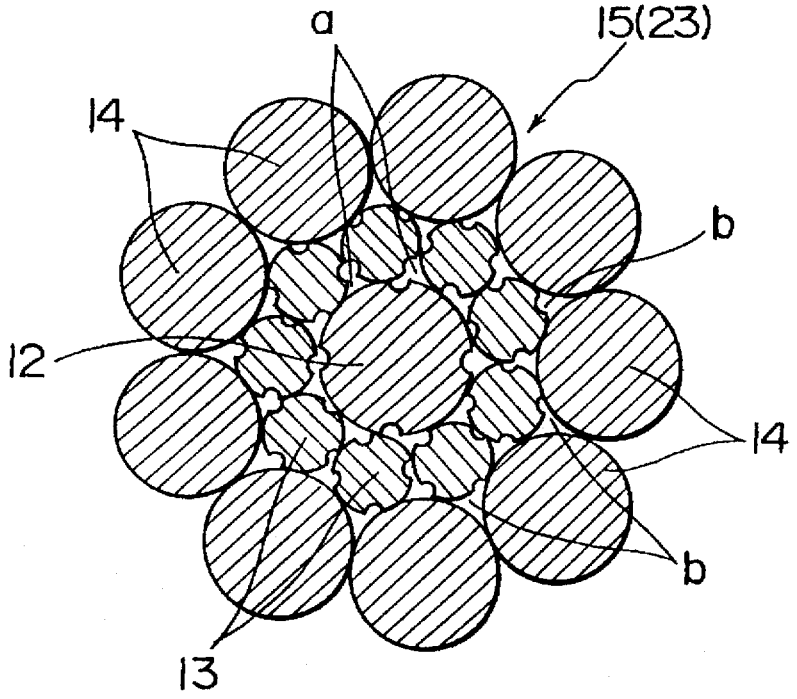
FIG. 15 is a cross section of a further example of the PC strand used in this invention.
Figure 16:
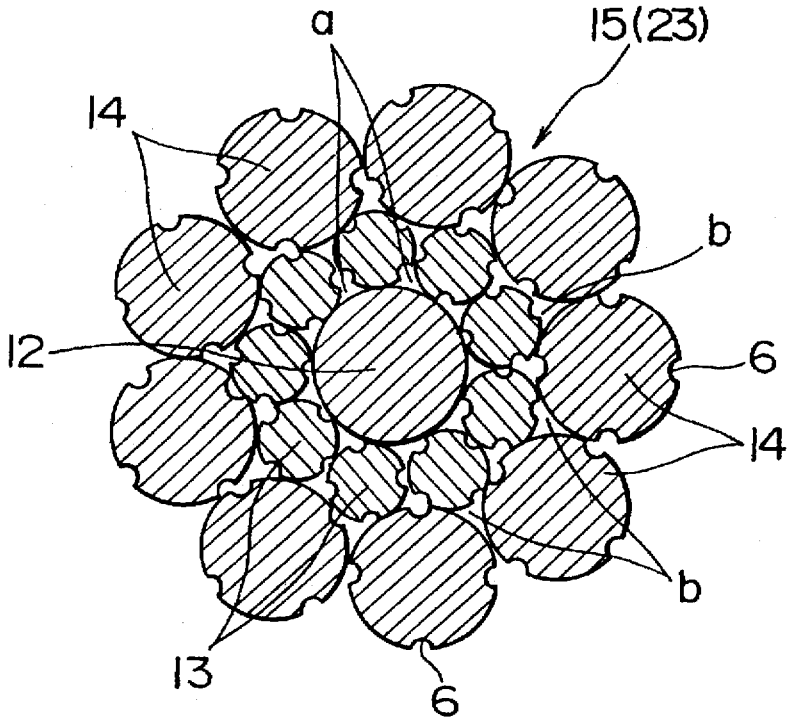
FIG. 16 is a cross section of the other example of the PC strand used in this invention.
Figure 17:
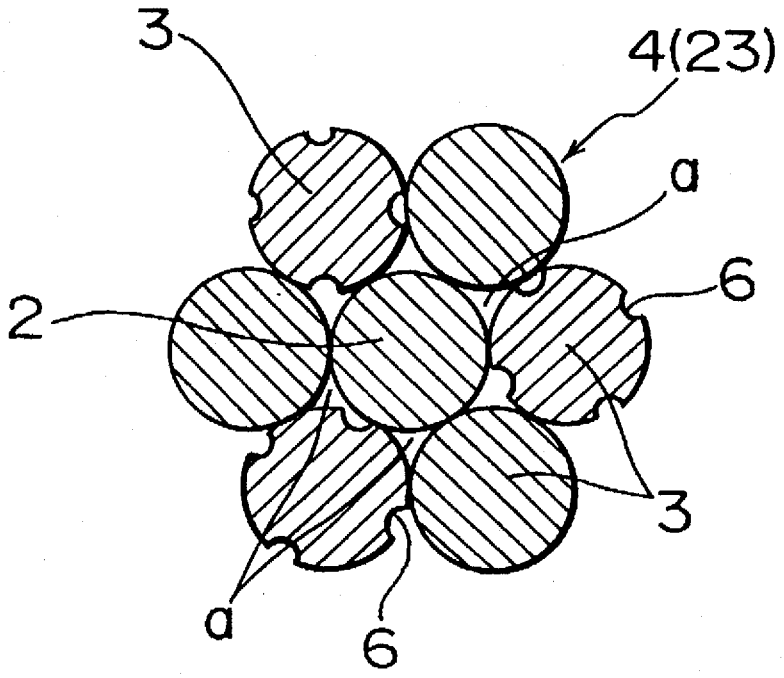
FIG. 17 is a cross section of the other example of the PC strand used in this invention.

In the PC strand body before being coated with rust inhibitive material, cores 2 and 12 and peripheral wires 3, 13 and 14 all are made of the deformed PC steel wires as shown in FIGS. 13 and 14. Of course, only the core 12 and the intermediate wires 13 may be made of the deformed PC steel wires as shown in FIG. 15, or all the peripheral wires 13 and 14 except for the core 12 may be made of the deformed PC steel wires as shown in FIG. 16.

Otherwise, every other peripheral wire 3 around the core may be made of the deformed PC steel wire. Thus, a variety of arrangements of the deformed PC steel wires may be applied.

Furthermore, the peripheral wires around the core may be formed by twisting seven wires, nineteen wires, twenty-eight wires, thirty-seven wires or forty-six wires.

As is apparent from the foregoing explanation, according to the present invention, porosity of the PC strand can be increased and made uniform so that molten thermoplastic resin serving as a rust inhibitor can smoothly permeate deep into the inside of the PC strand, because of the deformed PC steel wires used as the core and/or peripheral wires to form sufficient voids around the core and peripheral wires. Thus, the voids within the PC strand can be completely filled with the rust inhibitive material, and even a PC strand of a multilayer twisting type can be effectively coated with the rust inhibitive material.

It is to be understood that the invention is not limited in its application to the details of construction and arrangement of parts illustrated in the accompanying drawings, since the invention is capable of other embodiments and of being practiced or carried out in various ways. Also it is to be understood that the phraselogy or terminology employed herein is for the purpose of description and not of limitation.

What is claimed is:

1. A method for producing a PC strand coated with rust inhibitive material, which comprises twisting peripheral wires around a core to form a strand body having one or more layers of peripheral wires around said core, at least one of said peripheral wires being made of a deformed PC steel wire having an uneven outer surface such that voids are formed among said core and peripheral wires, passing said strand body through a synthetic resin extruder having a pressure head with a molding die while being heated, forcibly pressing molten thermoplastic resin into said strand body passing through said pressure head, thereby filling said voids with said molten thermoplastic resin and bringing said thermoplastic resin into intimate contact with said core and peripheral wires, and discharging said strand body from said molding die.

2. A method according to claim 1, wherein said peripheral wires made of deformed PC steel wires are used.

3. A method according to claim 1, wherein said core made of a deformed PC steel wire is used.

4. A method according to claim 2, wherein said core made of a deformed PC steel wire is used.

5. A method according to claim 1, wherein the uneven surface of the deformed PC steel wire is provided with grooves spirally extending longitudinally along the axis thereof.

6. A method according to claim 1, wherein the uneven surface of the deformed PC steel wire is provided with dot-shaped grooves.

7. A method according to claim 1, wherein the uneven surface of the deformed PC steel wire is provided with grooves extending laterally along the axis thereof.

8. A method according to claim 1, wherein the uneven surface of the deformed PC steel wire is provided with zigzag grooves extending substantially longitudinally along the axis thereof.

* * * * *